United States Patent [19]

Krugh

[11] Patent Number: 4,603,739

[45] **Date of Patent: * Aug. 5, 1986**

[54] PROCESS FOR CLEANING AN OIL FIELD WELL BORE HOLE USING AN INTERNAL CASING WIPER

[75] Inventor: Michael E. Krugh, Lafayette, La.

[73] Assignee: Marathon Oil Company, Findlay, Ohio

[ * ] Notice: The portion of the term of this patent subsequent to May 7, 2002 has been disclaimed.

[21] Appl. No.: 693,487

[22] Filed: Jan. 22, 1985

Related U.S. Application Data

[63] Continuation of Ser. No. 459,566, Jan. 20, 1983, Pat. No. 4,515,212.

[51] Int. Cl.[4] ..... E21B 31/08; E21B 31/03; E21B 37/00; E21B 37/02

[52] U.S. Cl. ..... 166/311; 166/99; 166/170

[58] Field of Search ..... 166/99, 170, 173, 162, 166/165, 311

[56] References Cited

U.S. PATENT DOCUMENTS

| | | | |
|---|---|---|---|
| 2,617,486 | 11/1952 | Davis | 166/99 |
| 3,500,933 | 3/1970 | Burba, Jr. et al. | 166/311 |
| 3,730,268 | 5/1973 | Burnside | 166/311 X |
| 4,059,155 | 11/1977 | Greer | 166/99 X |
| 4,515,212 | 5/1985 | Krugh | 166/99 |

*Primary Examiner*—Stephen J. Novosad

*Assistant Examiner*—David J. Bagnell

*Attorney, Agent, or Firm*—Jack L. Hummel; Rodney F. Brown

[57] ABSTRACT

The invention provides a process for using an internal casing wiper tool 10 to wipe the casing sides 10 of a well bore hole 30 in order to remove debris 60 contained thereon and further to remove debris 60 contained in fluid found in the bore hole 30. The tool includes a first chamber 210 for collecting larger sized pieces 430 of debris 60 and a second chamber 300 for collecting the smaller sized pieces 440 of debris 60 as the tool is lowered into the well bore hole 30. The tool includes an elongated tube 100 having its upper end 310 connected to the lower end 350 of the drilling string 20 internally containing the first 210 and second 300 chambers, a plurality of centralizers 130 are disclosed around the tube 100 for substantially centering the tube 100 in the bore hole, a petal basket 110 is connected to the lower end 102 of the tube having a plurality of outwardly extending petals 120 around its periphery for wiping the casing sides in order to dislodge the debris and to guide the fluid with the debris into the tube 100, a first filter 160 is located at a first predetermined distance 150 from the lower end 102 of the pipe 100 and separates out the larger pieces 430 of debris 60 and a second filter 230 is located above the first filter for separating out the smaller pieces 440 of debris 60, a check valve 320 is located above the second filter 230 and permits the cleaned fluid to flow outwardly from the tool 10 back into the well bore 30.

4 Claims, 6 Drawing Figures

Fig. 2
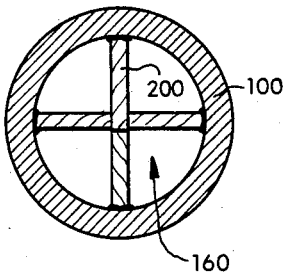
Fig. 3
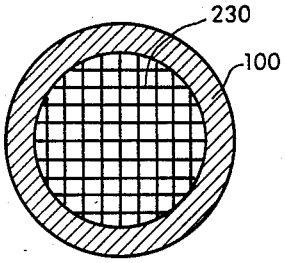
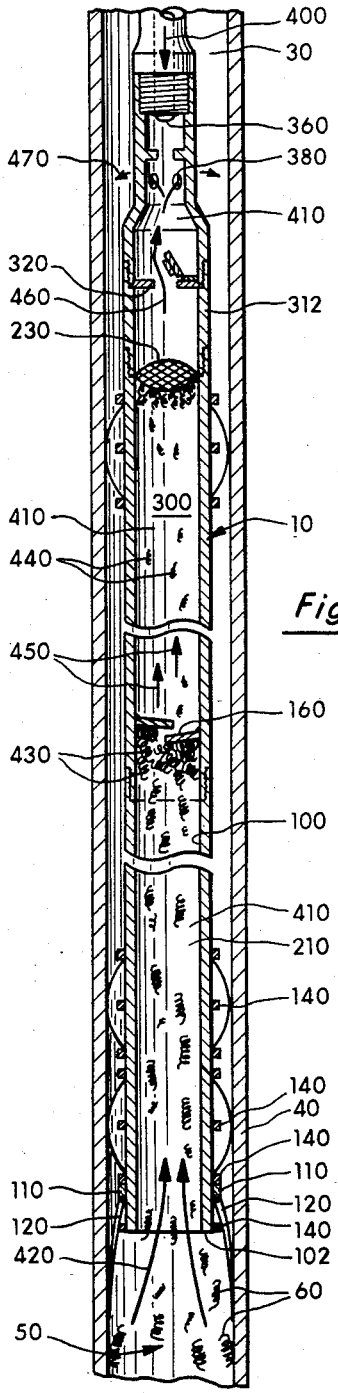
Fig. 4

PROCESS FOR CLEANING AN OIL FIELD WELL BORE HOLE USING AN INTERNAL CASING WIPER

DESCRIPTION

This is a continuation application of a copending U.S. patent application Ser. No. 459,566, filed on Jan. 20, 1983 now U.S. Pat. No. 4,515,212 and entitled "Internal Casing Wiper For An Oil Field Well Bore Hole."

TECHNICAL FIELD

The present invention relates to a process for removing debris and other material in a cased well bore hole using an internal casing wiper wherein the internal casing wiper is connectable to a drill string.

BACKGROUND ART

A variety of different types of debris known as "junk" can accumulate in a conventional oil well bore hole. Such "junk" includes metallic shavings, chips, twists, or curls dispersed throughout the length of the bore hole and which may adhere to the casing wall by natural magnetism. Such debris can also include portions of expendable tools, broken tools, or other tools items left in the well as well as any other foreign matter which may have fallen into the well. For example, when a portion of a casing is cut or milled in order to provide an offshoot from the bore hole, a considerable amount of cuttings are generated varying in length from several feet to several inches or less. It is roughly estimated that, in certain cases, for every five feet of casing milled approximately a barrel of cuttings are generated. In another situation, aluminum strapping bands are used to tie down electric cables in down hole electric pumps. These strapping bands can break and accumulate in the bore hole. The present invention is designed to primarily retrieve the type of junk described in the aforesaid two examples although it can also be used to retrieve other forms of conventional junk.

A number of conventional approaches exist for removing debris from the oil well bore hole such as the circulation of drilling mud to carry upwardly and outwardly from the well bore hole the smaller items of debris, the use of magnets to attract the metallic items and various other types of fishing equipment.

As a result of a patentability search conducted for the present invention, the following prior art patented approaches were uncovered:

| INVENTOR | U.S. PAT. NO. | DATE ISSUED |
|---|---|---|
| Fortenberry | 2,645,290 | July 14, 1953 |
| Baker | 2,687,913 | Aug. 31, 1954 |
| Hall, Sr. | 2,717,650 | Sept. 13, 1955 |
| Caudill | 2,916,091 | Dec. 8, 1959 |
| Anderson | 3,023,810 | March 6, 1962 |
| Jennings | 3,382,925 | May 14, 1968 |
| Burba, Jr. | 3,500,933 | March 17, 1970 |
| Baumstimler | 3,651,867 | March 28, 1972 |
| Oliver | 3,814,180 | June 4, 1974 |
| Best | 4,189,000 | Feb. 19, 1980 |
| Wayt | 4,332,296 | June 1, 1982 |

The 1970 patent to Burba, Jr. et al (U.S. Pat. No. 3,500,933 sets forth an apparatus for removing debris which includes a positive action wiper in the form of molded rubber cups for actually scraping the sides of the casing as the apparatus is moved downwardly into the oil well bore hole. As the Burba, Jr. et al apparatus is moved downwardly, the drilling mud is forced through the center of the tool and upwardly through an internal flow member, through a flapper valve and thence into an area of greater diameter which effectuates a separation of the heavier particles from the flow of the mud which are then caught in an entrapment chamber. As the tool is pulled upwardly, the flapper valve closes and the elongated slots on the side of the entrapment chamber allow the mud to flow freely therethrough while retaining the debris.

In the 1968 Jennings (U.S. Pat. No. 3,382,925), the 1974 Oliver (U.S. Pat. No. 3,814,180), and the 1962 Anderson (U.S. Pat. No. 3,023,810) patents, outwardly jetting fluid is utilized to dislodge debris accumulated on the walls of the casing. In these approaches, the outwardly jetting fluid provides the wiping action. The fluid is inputted from the drilling string and then is typically jetted outwardly around the periphery of the tool. In each of these approaches, a trap or chamber is provided for containing the collected debris. In the Anderson approach, a lower trap 25 is utilized to collect and contain the larger debris and a smaller trap 32 is utilized to entrap and contain the smaller debris. In these approaches the possibility exists that debris will be bypassed by the cleaning tool since the tool does not abut or actually scrape the sidewalls of the casing. In that event, debris can actually ball-up behind the tool and prevent removal of the tool from the bore hole.

The 1953 patent to Fortenberry (U.S. Pat. No. 2,645,290) also discloses a "junk" basket having a lower chamber for entrapping larger pieces of debris and an upper chamber for entrapping smaller pieces of debris. Fortenberry generates an upwardly directed high velocity jet for inducing a secondary circulation in the tool to cause the collected junk to move readily into the junk basket. Hence, Fortenberry is designed to be utilized while circulating the drilling fluid. As in the three above described patented approaches, Fortenbery also utilizes cutting teeth at the bottom of the tool in an effort to reduce the size of the larger pieces of debris to smaller pieces.

The 1954 patent to Baker (U.S. Pat. No. 2,687,913) also sets forth a tool for collecting and entrapping larger sized pieces of debris in a lower portion and smaller sized pieces of debris in an upper portion of the tool. Like the teachings of Burba, Jr. et al, Baker is designed to work in a static fluid environment (i.e., drilling fluid or other types of fluid are not pumped down into the tool to create various jets). As the tool is dropped, the Baker junk catcher is spring loaded so that when debris is encountered, the tool opens to collect the debris. When collected, the tool closes and can be lifted upwardly to remove debris.

The remaining patents uncovered in the search set forth various structural forms of well cleaning tools or casing scrapers embodying structural approaches which are not as close to the present invention as those disclosed in the above references.

Of all of the above prior patented art approaches, only the Baker and the Burba, Jr. patents, are relevant to the teachings of the applicant's invention by operating in a static fluid environment without the introduction of drilling fluid to create a jetting action. One disadvantage with the Burba, Jr. approach is the consumption of the wiper cups which, made of rubber, must be replaced after use. Furthermore, the wearing of the rubber cups causes rubber to be placed into the bore hole and rubber debris is difficult to retrieve. Additionally, Burba does not scrape or wipe at a point at or near the end of the tool and milled cuttings can ball up and nest between the rubber cup and the end of the tool possibly causing the tool to stick. And finally, Burba must permit junk to flow through a valve 80 before separation occurs. Such an arrangement may cause the clogging of the valve by large pieces of junk or by the capture of milled curlings. The disadvantage inherent in the Baker approach resides in the fact that actual wiping or scraping action against the casing wall does not occur. The possibility exists in Baker that debris clinging to the sides of the casing will be bypassed and, as previously discussed, ball up behind the tool.

DISCLOSURE OF INVENTION

A need exists for a well bore hole cleaning process utilizing a simple economical tool. Furthermore, a process is desired that can be used in a static environment with no fluids flowing and which will thoroughly wipe the sides of the casing and prevent the possibility of debris accumulating behind the tool while retrieving cuttings and the like.

The present invention satisfies these needs, using an internal casing wiper tool which includes an elongated tube having a first collection chamber and a second collection chamber disposed therein, and a petal basket located at its lower end. As the tool travels downwardly through the well bore hole, the petal basket wipes the sides of the casing and directs the fluid containing the debris to an internal passageway, through a first filter or trap where larger pieces of debris are separated and collected in the first chamber, and upwardly through a second filter where the smaller pieces of debris are separated out from the fluid and collected in the second chamber. The cleaned fluid then is delivered through a check valve located below the cross-over joint at the upper end of the tube and out through a plurality of formed ports back into the well bore hole. In this fashion, all of the fluid in the well bore hole is filtered and debris found on the walls of the casing is removed. A drill pipe float is further provided at the end of the drill string to prevent any of the fluids from entering into the drill string. Finally, a plurality of centralizers disposed around the outer periphery of the tube support the tool substantially in the center of the bore hole.

In comparison to the conventional prior art approaches, the present invention provides a process for thoroughly cleaning the fluid in a well bore hole by scraping and wiping the casing sides free of debris while maintaining the fluid in a substantially static environment (i.e., without the injection of additional fluids) using a simply designed tool made from conventional parts. Furthermore, the scraping or wiping action occurs at the end of the tool to minimize the balling or nesting of cuttings in the tool. Finally, the dual filtering action of the present invention prevents junk from passing through the operating valves.

BRIEF DESCRIPTION OF THE DRAWINGS

The details of the present invention are described in the accompanying drawings:

FIG. 2 is a sectional view on the line 2—2 of FIG. 1 illustrating in more detail the structure of the first filter;

FIG. 3 is a sectional view on the line 3—3 of FIG. 1 illustrating in more detail the structural arrangement of the second filter;

FIG. 4 is a vertical sectional view illustrating the debris collection mode of the process. The tool is lowered into the fluid-filled well bore hole creating relative circulation through the tool and the wiping action of the tool on the casing;

BEST MODE FOR CARRYING OUT THE INVENTION

Figure 1:
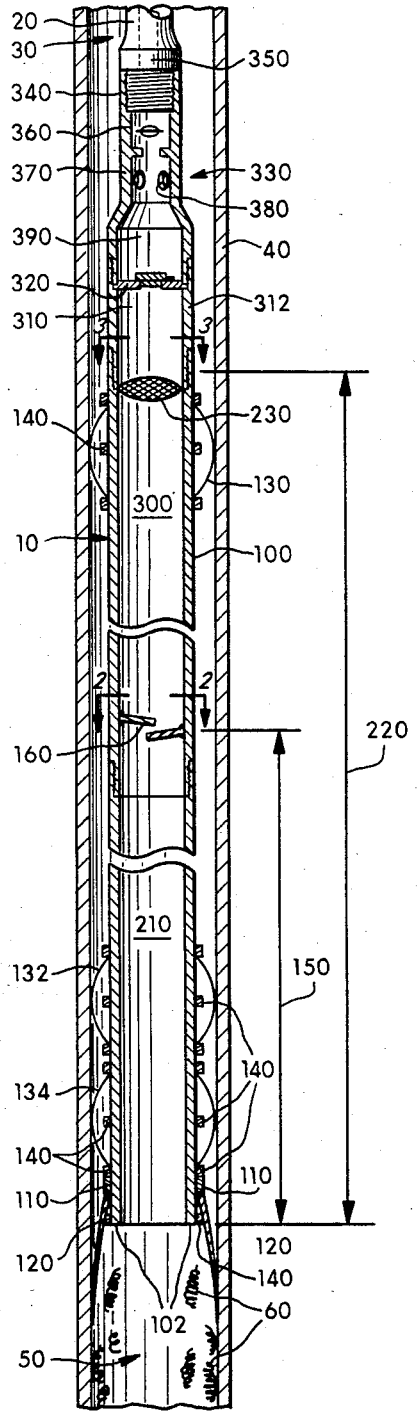
FIG. 1 is a vertical sectional view illustrating the tool used in the present invention secured to the lower end of a drill string in a well bore hole.

In FIG. 1, the internal casing wiper tool 10 as used in the process of the present invention is affixed to a conventional drill string 20 and is disposed in a well bore hole 30 having a standard casing 40 disposed therein. The well bore hole contains fluid 50 and debris 60. Some of the debris 60 clings to the sides of the casing 40 and some is actually disposed in the fluid 50. It is the function of the tool 10 to be connected to the drill string 20 and to be lowered into the well bore hole 30 to wipe the debris 60 from the casing wall and to clean the debris 60 from the fluid and then to collect the debris 60 and store it internally in the tool.

The tool 10 includes an elongated tube 100 having connected to its lower end 102 a conventionally available metal petal basket 110 having outwardly extending petals 120 for scraping or wiping the casing 40 to remove any debris magnetically clinging thereto. The metal petal basket 100 also serves to guide or funnel the fluid into the tube as will be subsequently described. Such baskets are typically used in a cementing process for cementing well casings and endure well in an abrasive environment. In the preferred embodiment, the basket 110 is a conventional cement metal petal basket, with metal strapping reinforcement provided thereto of the type manufactured by Bakerline
Division of Baker International, Inc.
6110 Rittiman Road
P. O. Box 18628
San Antonio, Tex. 78218
Product No. 231-01

The basket 110 conventionally engages the elongated tube 100 by means of an upper and lower step ring 140.

The petals 120 are held outwardly against and firmly abut the casing 40 by the pressure of the fluid 50 on petals 120 in order to firmly engage the casing and to provide the wiping or scraping action necessary under the teachings of the present invention. A plurality of centralizers 130, 132, 134 are disposed at various locations along the elongated tube 100 in order to support the tube substantially in the center of the well bore hole 30. In the preferred embodiment, two of the centralizers 132 and 134 are located near the lower end 102 of the tube 100 in order to stabilize the end as it is wiping the casing 40. The centralizers are conventionally available from:

Halliburton Services
1015 BoisD'arc Street

P.O. Drawer No. 1431
Duncan, Okla. 73533
Model No. S-3

Stop rings 140 are used to hold centralizers 130, 132, and 134 in position.

In the preferred embodiment two or more lengths of conventional seven inch in diameter casing pipes are joined together. Each section is 38 to 45 feet long and two to three sections may be utilized. It is to be expressly understood that the diameter of the tube is a function of the diameter of the casing and, in the preferred embodiment, a seven inch diameter for the tube is designed to operate with a nine and five/eighths inch casing for the well bore hole 30.

Located a first predetermined distance away from the lower end 102 of the tube 100 is a first filter or trap 160 which, as shown in FIG. 2, is comprised of a number of several lengths of cable 200 which are welded inside the tube 100. The plurality of cable lengths 200 act to trap the larger pieces of debris or junk and to collect those pieces in a first chamber 210 as shown in FIG. 1. The first chamber 210 begins at end 102 and extends upwardly through the tube 100 to the location of the filter 160 the entire predetermined distance 150.

Located a second predetermined distance 220 above the lower end 102 is a second filter 230 which is composed of a wire screen mesh, a slotted steel plate, or a perforated plate. In the preferred embodiment shown in FIG. 3, the second filter 230 is made of sturdy quarter inch mesh wire screen. A second chamber 300 is formed between the first filter 160 and the second filter 230 and serves to collect the smaller pieces of debris as will be subsequently set forth. At the upper end 310 of the tube 100, a standard check valve 320 is inserted between one casing pipe and a small casing pipe section 312 of about five feet in length. The check valve 320 functions to permit the fluid 50 to flow upwardly through passageway 410. The check valve is conventionally available from:

Davis-Lynch, Inc.
Box 12326
Houston, Tex. 77017
Type 904F

A cross-over joint 330 is affixed to the check valve 320 at the upper end 310 of the tube 100. The cross-over joint 330 essentially adapts the diameter of the tube 100 to the smaller diameter of the drilling string 20 and, therefore, the upper end 340 of the cross-over joint 330 is connected to the lower end 350 of the drill string 20 in a conventional fashion. The cross-over joint 330 includes an inserted standard drill pipe float 360, a mid-section region 370 having a plurality of formed ports 380 and an enlarged section 390 for engagement above the check valve 320. The formed ports 380 function to allow the fluid 50 to flow out from the tool into the bore hole. The drill pipe float 360 functions to prevent any fluid such as drilling mud from entering into the drill string 20 and is conventionally available from:

Bakerline
Division of Baker International, Inc.
6110 Rittiman Road
P. O. Box 18628
San Antonio, Tex. 78218
Model F
No. 480-13

Figure 6:
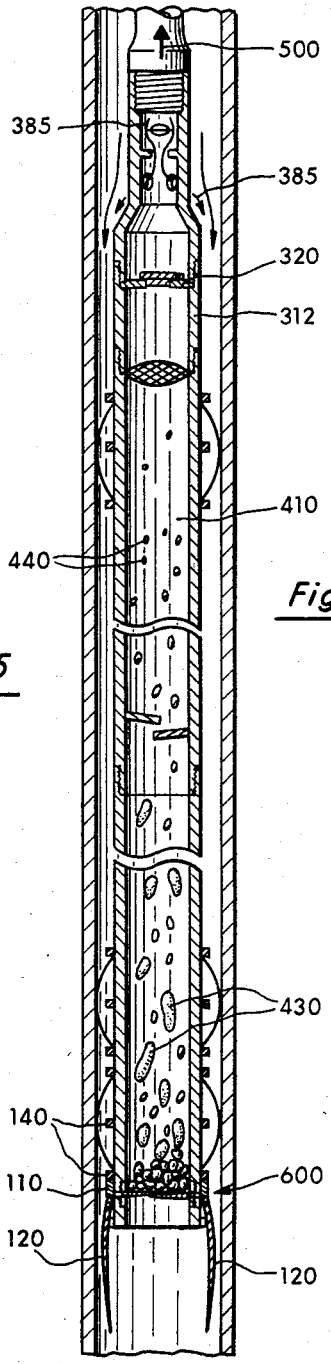
FIG. 6 is a vertical sectional view illustrating an alternate embodiment of the tool used in the process of the present invention for retrieving debris from a well bore hole.

When the tool is lowered into the wellbore as shown in FIG. 4 by arrow 400, the use of the drill pipe float 360 necessitates the filling of the drill string 20 from the surface as is commonly done. When the tool is pulled from the hole, as shown in FIG. 6 by arrows 385, the fluid in the drill string 20 will drain itself through the float 360 and out the ports 380 into the annular area outside the drill string 20.

Figure 5:
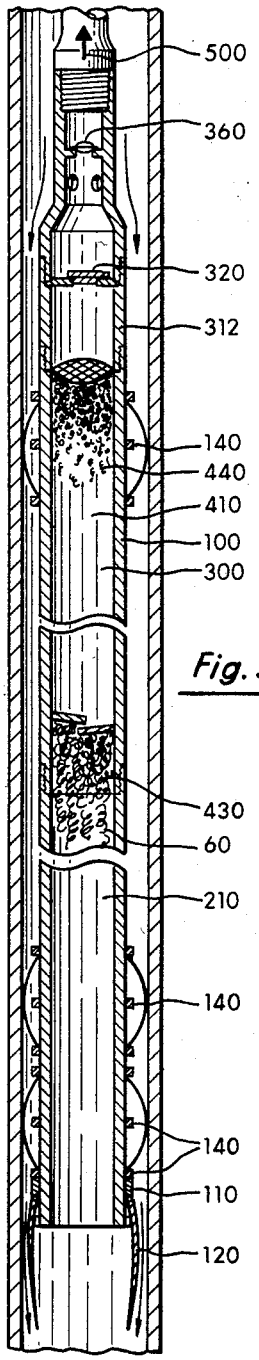
FIG. 5 is a vertical sectional view illustrating the debris retrieval mode of the process. The tool is raised from the well bore hole preventing relative circulation of the fluid through the tool and retrieving debris from a well bore hole.

The process of the present invention is set forth in FIGS. 4 and 5. FIG. 4 illustrates the collection mode of the process. The tool 10 is lowered downwardly in the bore hole 30 in the direction of arrow 400. As mentioned, the bore hole 30 contains fluid 50, such as drilling mud, with debris 60 such as milled curlings. As the tool 10 travels downwardly in the direction of arrow 400, the petals 120 of the metal basket 110 under the pressure of fluid 50 wipe or scrape the sidewalls of the casing 40 to clean the debris clinging on the sidewalls and to guide the fluid 50 and debris 60 upwardly into a passageway 410 of the tube 100. The upward flow of the fluid as depicted by arrows 420 cause the larger pieces 430 of the debris 60 to separate at filter 160 while permitting the fluid containing the smaller pieces of debris 440 to flow upwardly into the second chamber 210. Hence, the larger pieces 430 of the debris are snagged and become nested and, hence, collected in lower chamber 300. When this occurs, and especially in the case of milled curlings, the nested debris also contributes to the filtering or entrapment action. As the fluid 50 with the smaller pieces 440 of debris 60 move upwardly in the passageway 410 the smaller pieces of debris 440 are separated out from the fluid at the second filter 230 and are collected in the second chamber 300, as shown by arrows 450. The fluid then flows, free of junk except for minute sized pieces, as shown by arrow 460 through the check valve 320 which opens to permit the upward flow of the fluid 50 and outwardly through ports 380 in the directions of arrows 470 and back into the well bore hole 30. At this point, the fluid is cleaned and essentially remains static in the well bore.

In this fashion, the tool 10 of the present invention wipes the casing 40 and entraps the larger pieces 430 of debris 60 in the first chamber 210 and the smaller pieces 440 of the debris 60 in a second chamber 300.

FIG. 5 illustrates the retrieval mode of the process. Once the tool has been run in the well to the desired depth and the casing has been wiped, the tool is simply pulled back out of the hole causing the check valve 320 to close and to trap the larger pieces 430 of the debris 60 in the first chamber 210 and the smaller pieces 440 of debris 60 in the second chamber 300 under a static pressure created inside tube 100 and due to the nesting of the debris. The metal petals 120 relax to a vertical position due to the change of fluid pressure on the petals, the fluid pressure being caused by the movement of the tool being pulled out of the hole. In some circumstances, it may be desirable to forcibly bend the petals 120 into the bottom end 102 of the casing to further assure that all entrapped debris will be pulled upwardly and out of the bore hole.

In FIG. 6 an alternate embodiment of the tool used in the present invention is shown incorporating a conventional finger basket 600 which operates to close as the tool is lifted up and opens as the tool is lowered. In the situation where the debris in the bore hole does not nest near the filters, a finger basket can be conventionally used to close off the lower end of the tool to allow retrieval of the junk.

Although the process of the present invention has been set forth in a preferred embodiment it is expressly understood that changes or modifications may be made in the process without departing from the spirit or teachings of the present invention as set forth in the following claims.

I claim:

1. A process for removing debris from a cased well bore hole containing a fluid in a substantially static environment comprising the steps of:

continuously lowering a tubular tool into the well bore hole during a collection mode to create relative circulation of the fluid through the tubular tool while;

scraping the debris from the casing of the well bore hole into the fluid by a scraping means affixed to the lower end of the tubular tool;

feeding the debris-containing fluid to the interior of the tubular tool via an opening in the lower end of the tool;

filtering the debris-containing fluid upward across a first filtering means cross-sectionally positioned within the tubular tool;

collecting the debris filtered from the fluid in a collection means positioned below the first filtering means in the tubular tool;

opening a valve, which permits upward flow of filtered fluid through the valve but not reverse downward flow of fluid through the valve and which is positioned cross-sectionally in the tubular tool above the first filtering means and below a port in the upper end of the tool;

expelling the filtered fluid from the interior of the tubular tool via the port which provides fluid communication between the interior of the tool and the well bore hole; and thereafter continuously raising the tubular tool in the wall bore hole during a retrieval mode while;

closing the valve to substantially prevent downward flow of fluid across the filtering means; and removing the debris contained in the collection means of the tubular tool from the well bore hole.

2. The process of claim 1 further comprising during the collection mode after filtering the debris-containing fluid across the first filtering means and collecting the debris therefrom, the steps of filtering the debris-containing fluid across a second filtering means, which is positioned above the first filtering means and below the valve and collecting smaller debris not filtered from the fluid across the first filtering means.

3. The process of claim 1 wherein the filtered fluid is expelled from the interior of the tubular tool via a plurality of ports positioned in the upper end of the tubular tool.

4. The process of claim 1 further comprising the step of substantially closing the opening in the lower end of the tool to substantially prevent debris in the tool from reentering the well bore during the retrieval mode.

* * * * *

UNITED STATES PATENT AND TRADEMARK OFFICE

CERTIFICATE OF CORRECTION

PATENT NO. : 4,603,739

DATED : August 5, 1986

INVENTOR(S) : Michael E. Krugh

It is certified that error appears in the above-identified patent and that said Letters Patent are hereby corrected as shown below:

Col. 1, line 25: Delete "tools" and insert --tool--.
Col. 1, line 64: After "3,500,933", insert --)--.
Col. 2, line 39: Delete "Fortenbery"and insert --Fortenberry--.
Col. 8, line 7: Delete "wall" and insert --well--.
Col. 8, line 10: After "the", insert --first--.

Signed and Sealed this

Eleventh Day of November, 1986

*Attest:*

DONALD J. QUIGG

*Attesting Officer* *Commissioner of Patents and Trademarks*